US005815969A

United States Patent [19]

Brouwer

[11] Patent Number: 5,815,969

[45] Date of Patent: Oct. 6, 1998

[54] SIGN FOR INDICATING THAT ASSISTANCE IS REQUIRED BY A PERSON IN A VEHICLE

[76] Inventor: John Brouwer, P.O. Box 286, Alliston, Ontario, Canada, L9R 1V5

[21] Appl. No.: 803,700

[22] Filed: Feb. 21, 1997

Related U.S. Application Data

[63] Continuation-in-part of Ser. No. 522,643, Sep. 1, 1995, abandoned.

[51] Int. Cl.[6] ..... G09F 13/04

[52] U.S. Cl. ..... 40/574; 40/591

[58] Field of Search ..... 40/573, 591, 593, 40/592, 574, 564, 572, 716, 720, 204, 205; 362/812

[56] References Cited

U.S. PATENT DOCUMENTS

| | | | |
|---|---|---|---|
| 3,305,961 | 2/1967 | Lanzon et al. | 40/591 |
| 3,418,738 | 12/1968 | Goodman | 40/574 |
| 4,272,901 | 6/1981 | Matthews | 40/578 |
| 4,373,284 | 2/1983 | Crane | 40/578 X |
| 4,969,282 | 11/1990 | Eberhart | 40/541 X |
| 5,339,551 | 8/1994 | Elmer | 40/591 |
| 5,711,100 | 1/1998 | Elmer | 40/592 |

*Primary Examiner*—Brian K. Green
*Attorney, Agent, or Firm*—Rogers and Scott

[57] ABSTRACT

A sign for indicating that assistance is required by a person in a vehicle. The sign has a body attachable to the exterior of the vehicle by a person inside the vehicle. The sign body contains an electric light connected by electrical wiring to an electrical plug insertable into an electrical socket in the vehicle. The electrical wiring includes an electrical flasher connected thereto, and the sign body has a message thereon. When the plug is inserted into the socket and the sign body is attached to the exterior of the vehicle, the light within the sign body flashes to cause the message to be readily visible to passers-by.

6 Claims, 3 Drawing Sheets

SIGN FOR INDICATING THAT ASSISTANCE IS REQUIRED BY A PERSON IN A VEHICLE

This is a continuation in part of application Ser. No. 08/522,643 filed Sep. 1, 1995, now abandoned.

This application relates to signs for indicating that assistance is required by a person in a vehicle.

BACKGROUND OF THE INVENTION

There is currently a need for an improved sign for indicating to others that someone in an automobile or other vehicle requires assistance. It is well known that someone in a car, particularly a woman, is vulnerable if the car breaks down, especially if the breakdown occurs in a deserted area and/or on a major highway.

It is therefore an object of the invention to provide such a sign.

SUMMARY OF THE INVENTION

According to the invention, a sign for indicating that assistance is required by a person in a vehicle comprises a body of elongated rectangular box-like shape and of translucent synthetic plastic material attachable to the exterior of the vehicle by a person inside the vehicle, said sign body containing an electric light connected by electrical wiring to an electrical plug insertable into an electrical socket in the vehicle, said electric wiring having an electrical flasher connected thereto, and said sign body having an opaque message thereon whereby, when the plug is inserted into the socket and the sign body is attached to the exterior of the vehicle, the light within the sign body flashes to cause the message and the translucent sign body to be readily visible to passers-by, said sign body having a first chamber adjacent an end thereof for storing said wiring and plug, said first chamber normally being closed by a first flap integrally hingedly connected to a longitudinal extending wall of the sign body and detachably securable to an opposite wall thereof to close said first chamber, and said sign body also having a second chamber adjacent an opposite end of the sign body containing said electric light and electrical flasher, said second chamber normally being closed by a second flap integrally hingedly connected to said longitudinal extending wall of the sign body and secured to said opposite wall to close said second chamber.

The invention provides a sign which is effective, inexpensive, easy to operate and readily portable. The electric light and elongated flasher may be mounted on an inner surface of the second flap. Advantageously, the electric light is located in a middle area of the length of the sign body. The sign body may have an integral bracket with a first portion extending beyond an end of the sign body from a wall thereof and a second portion extending downwardly from the first portion parallel to and spaced from said end of the sign body.

The first flap may have a front edge with a pair of spaced parallel short walls extending therealong in frictional engagement with opposite sides of the opposite wall of the sign body.

The second flap may have a series of longitudinally spaced short projecting posts, with the opposite wall of the sign body having a third flap integrally hingedly connected to the opposite wall and having a series of longitudinally spaced apertures receiving the posts in frictional engagement therewith to retain the second flap in the closed position.

BRIEF DESCRIPTION OF THE DRAWINGS

One embodiment of the invention will now be described, by way of example, with reference to the accompanying drawings, of which.

DESCRIPTION OF THE PREFERRED EMBODIMENT

Figure 1:
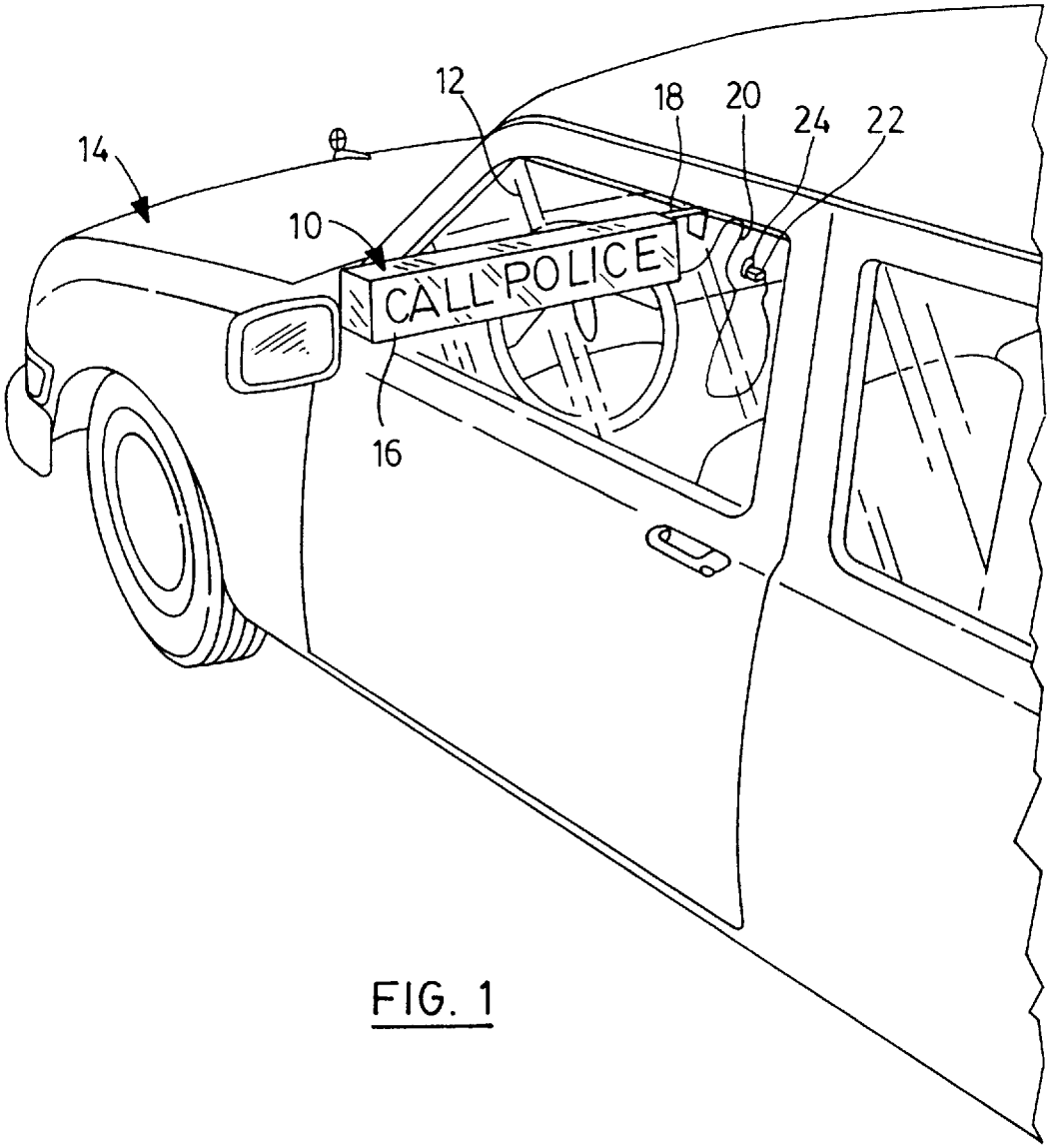
FIG. 1 is a perspective view of a portion of a car showing a sign in accordance with one embodiment of the invention attached to the driver's window.

Referring to the drawings, FIG. 1 shows a sign 10 in accordance with one embodiment of the invention attached to the driver's window 12 of a car 14. As will be described in more detail later, the sign 10 has a translucent sign body 16 attachable by an integral bracket 18 to the upper edge of the driver's window 12. The sign 10 also has electrical wiring 20 extending from the sign body 16 to an electrical plug 22 which fits into an electrical cigarette lighter socket 24 in the car 14.

The sign body 16 is of elongated rectangular box-like shape and is of moulded yellow translucent synthetic plastic material. The sign body 16 has a front portion 26, rear portion 28, top portion 30, bottom portion 32 and end portions 34, 36.

The bottom portion 32 comprises two side by side flaps 38, 40 whose rear edges are integrally connected by hinge portions 42, 44 respectively to the lower edge 50 of the front portion 26. The flap 38 extends for over half the length of the sign body 16, and is therefore somewhat longer than the flap 40. The front edge of the flap 38 has a series of small posts 52 at spaced positions along its length for a purpose which will be described shortly.

Figure 4:
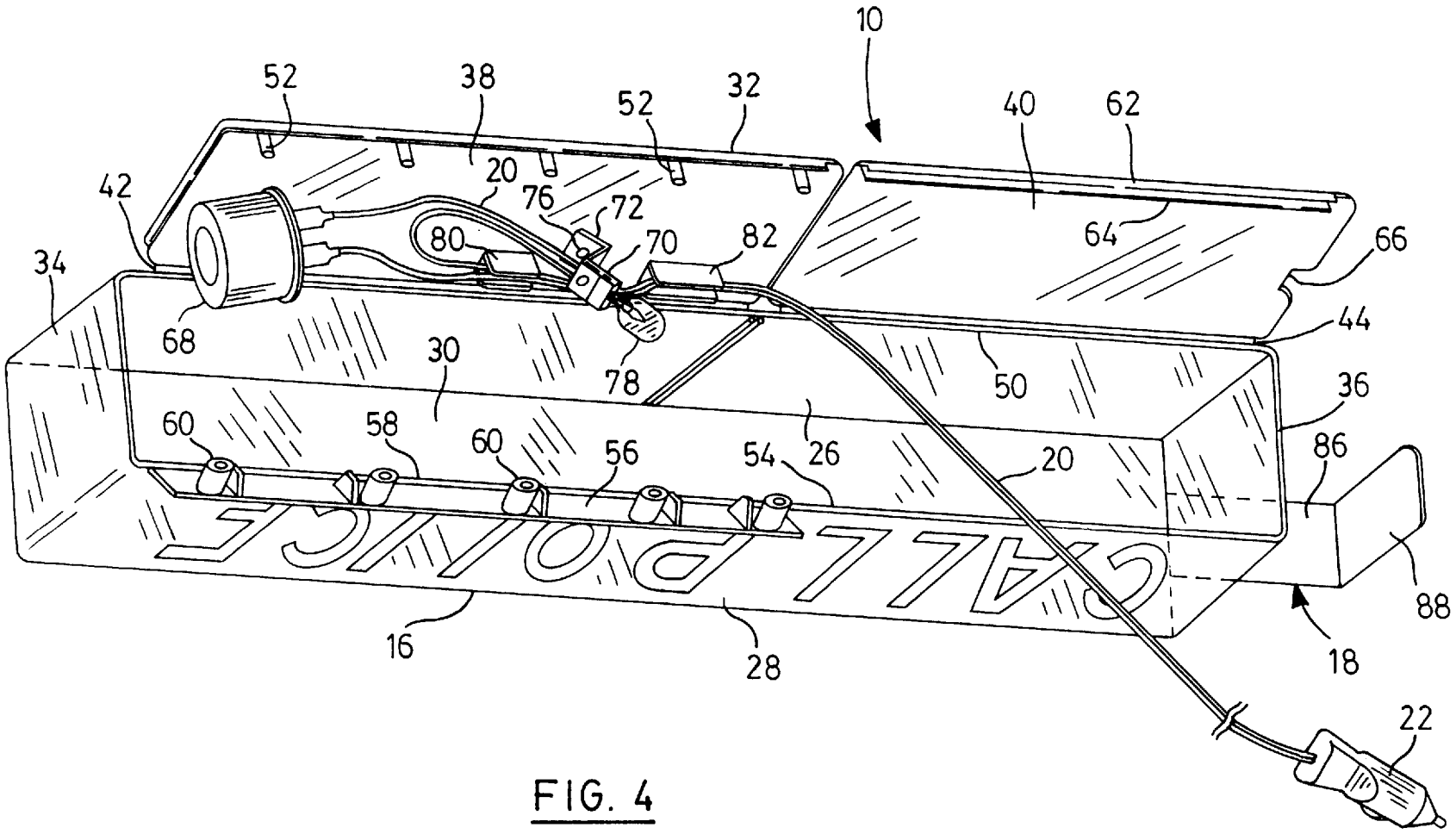
FIG. 4 is a similar view with the sign body open to show the interior thereof.

The bottom edge 54 of the rear portion 28 has a small flap 56 opposite the flap 38 and integrally connected by a hinge portion 58 to the lower edge 54 of the rear portion 28 of the sign body 16. The flap 56 has a series of small hollow cylindrical projections 60 at spaced positions along its length opposite the posts 52 on the flap 38. The flap 38 can be closed by first folding the flap 56 inwardly from the position shown in FIG. 4, then folding the flap 38 inwardly and pushing the posts 52 into the cylindrical projection 60 where they are firmly held therein by friction.

The front edge of flap 40 has a pair of spaced parallel short walls 62, 64 extending therealong, their spacing being equal to the thickness of the rear portion 28. The flap 40 can be closed by folding it across the bottom of the sign body 16 and pushing the walls 62, 64 over the bottom edge 54 of the rear portion 28, with the wall 62 being on the outside and the wall 64 being on the inside thereof. The flap 40 is held in the closed position in a readily releasable manner by frictional engagement of the wall 62, 64 with the rear portion 28. The end of the flap 40 adjacent the end portion 36 of the sign body 16 has a recess 66 for a purpose to be described later.

An electrical flasher unit 68 is mounted on the inside of flap 38 in any convenient manner adjacent the end portion 34, and a lamp socket 70 is mounted on a bracket 72 secured by a rivet 74 to the inside of the flap 38 at a position in the middle area of the length of the sign body 16.

The socket 70 carries a lamp bulb 78, and the electrical wiring 20 connects to lamp bulb 78 through the flasher 68 to the plug 22. Portions of the wiring 20 adjacent the flap 38 are retained in an appropriate manner (80, 82) formed integrally with the flap 38.

When not in use, the plug 22 and associated wiring 20 are stored in the portion of the sign body 16 adjacent flap 40.

The bracket 18 has a first portion 84 extending beyond the end portion 36 from the top portion 30 of the sign body 16, and a second portion 88 extending downwardly therefrom and parallel to and spaced from the end portion 36.

The exterior of the front and rear portions 26, 28 of the translucent sign body 16 carry an opaque message, in this case the words "CALL POLICE" in black letters.

It will be readily understood that the above described sign is compact, lightweight, inexpensive, and readily portable. Further, the sign can be stored conveniently in a car within easy reach of the driver.

If use of the sign becomes necessary, for example because the car has broken down at night and/or in an unhospitable location, the driver simply opens the flap 40, and then pulls out the plug 22 and a suitable length of wiring 20. The flap 40 is then re-closed, with the wiring 20 passing through the notch 66 in the flap 40.

Figure 2:
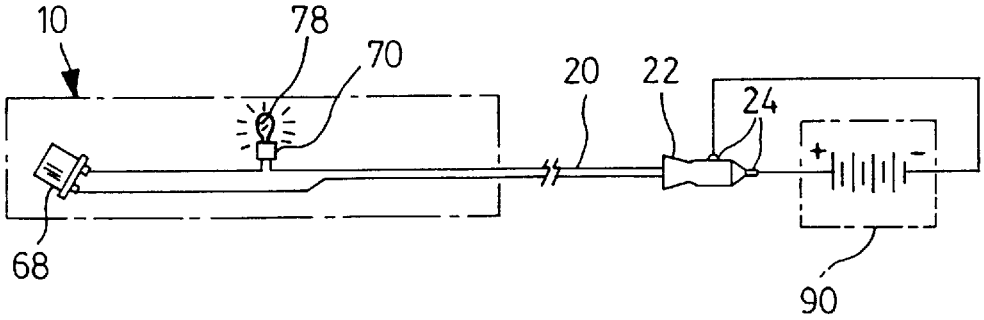
FIG. 2 is an electrical circuit diagram showing the electrical circuit associated with the sign.
Figure 3:
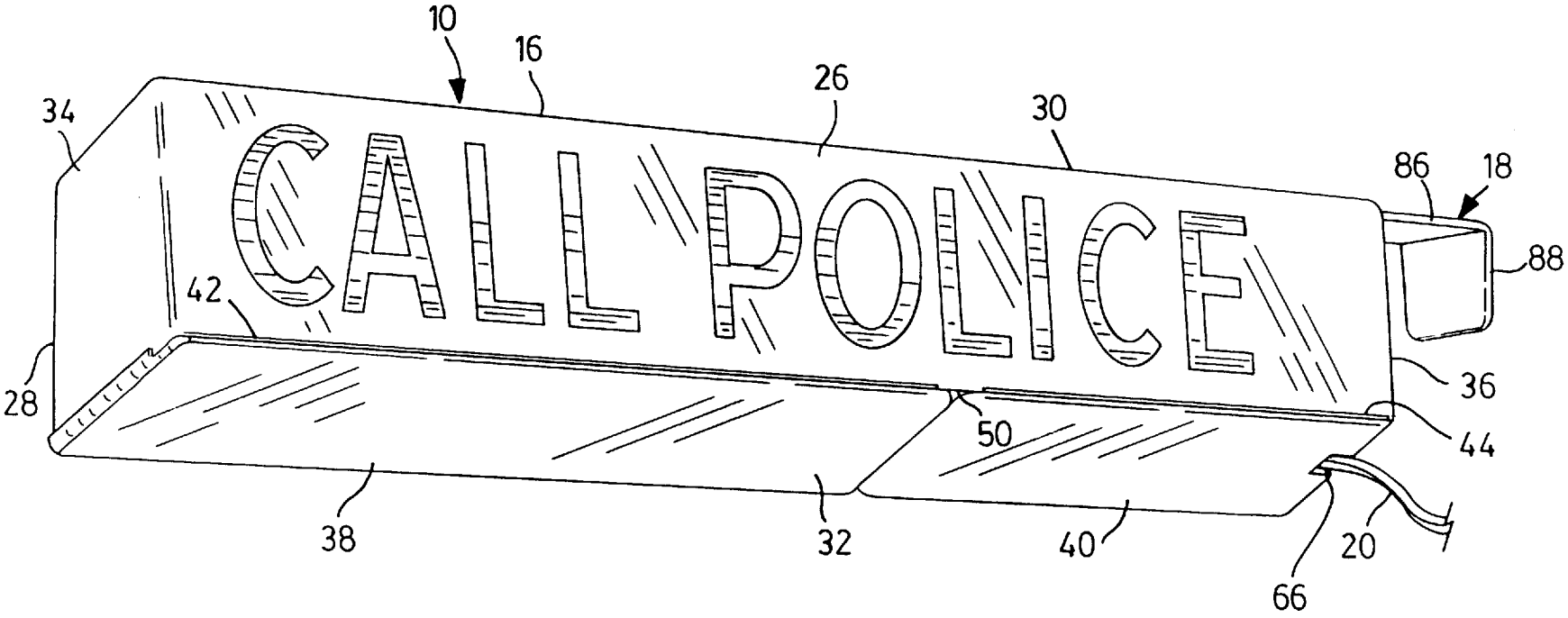
FIG. 3 is an enlarged perspective view of the sign.

The driver then lowers the window 12 sufficiently to be able to position the sign body 16 outside the car 14 with the bracket 18 over the top edge of the window 12, so that the sign body 16 projects laterally outwardly from the car 14. The window 12 is then returned to its closed position, as indicated in FIG. 1. The plug 22, which with sufficient wiring 20, is retained in the car 14 (with the wiring 20 passing over the upper edge of the window 12), is then pushed into the cigarette lighter socket 24 which is supplied with electrical power by the car battery 90, see FIG. 2. The bulb 68 will then be illuminated in a flashing manner.

The flashing light within the translucent sign body 16 will not only draw attention to the sign body 16 itself because of its translucency but will also highlight the opaque words "CALL POLICE" so that this message will be prominently displaced in a eye-catching manner to passers-by. The result is that, not only will passers-by be alerted to the fact that the police should be called, but also passers-by with possible criminal intent will be deterred from criminal activity because they will not know whether or not police have been called and, if they have, how far away from the scene they are. Thus, the invention enhances personal safety and security and eliminates any need for a person to leave the vehicle to seek assistance.

The value of a sign in accordance with the invention will therefore be readily apparent from the foregoing description of a preferred embodiment. Other embodiments of the invention will also be readily apparent to a person skilled in the art, the scope of the invention being defined in the appended claims.

I claim:

1. A sign for indicating that assistance is required by a person in a vehicle, said sign comprising a body having an elongated rectangular box-like shape, said body being translucent synthetic plastic material, and said sign is adapted to be attached to an exterior of the vehicle by a person inside the vehicle, said sign body enclosing an electric light connected by electrical wiring to an electrical plug which is adapted to be inserted into an electrical socket in the vehicle, said electric wiring having an electrical flasher connected thereto, and said sign body having an opaque message thereon whereby, when the plug is inserted into the socket and the sign body is attached to the exterior of the vehicle, the light within the sign body flashes to cause the message and the translucent sign body to be readily visible to passers-by, said sign body having a first chamber adjacent an end thereof for storing said wiring and plug, a first flap integrally hingedly connected to a longitudinal extending wall of the sign body and detachably securable to an opposite wall thereof to close said first chamber, and said sign body also having a second chamber adjacent an opposite end of the sign body containing said electric light and electrical flasher, and a second flap integrally hingedly connected to said longitudinal extending wall of the sign body and secured to said opposite wall to close said second chamber.

2. A sign according to claim 1 wherein the electric light and electrical flasher are mounted on an inner surface of the second flap.

3. A sign according to claim 2 wherein the electric light is located in a middle area of the length of the sign body.

4. A sign according to claim 1 wherein the sign body has an integral bracket with a first portion extending beyond an end of the sign body from a wall thereof and the second portion extending downwardly from the first portion parallel to and spaced from said end of the sign body.

5. A sign according to claim 1 wherein the first flap has a front edge with a pair of spaced parallel short walls extending therealong and frictionally engaged with opposite sides of said opposite wall of the sign body.

6. A sign according to claim 1 wherein the second flap has a series of longitudinally spaced short projecting posts, and said opposite wall of the sign body has a third flap integrally hingedly connected to said opposite wall and having a series of longitudinally spaced apertures receiving said posts in frictional engagement therewith to retain the second flap in the closed position.

* * * * *